US007313996B2

(12) United States Patent
Werner

(10) Patent No.: US 7,313,996 B2
(45) Date of Patent: Jan. 1, 2008

(54) HANDHELD FIREARM

(75) Inventor: Martin Werner, Elchingen (DE)

(73) Assignee: Carl Walther GmbH, Ulm (DE)

( * ) Notice: Subject to any disclaimer, the term of this patent is extended or adjusted under 35 U.S.C. 154(b) by 120 days.

(21) Appl. No.: 11/100,638

(22) Filed: Apr. 7, 2005

(65) Prior Publication Data

US 2006/0011059 A1 Jan. 19, 2006

(51) Int. Cl.
*F41A 3/00* (2006.01)

(52) U.S. Cl. ..... 89/181; 42/70.01

(58) Field of Classification Search .... 42/70.01–70.11; 89/142, 148, 180, 181
See application file for complete search history.

(56) References Cited

U.S. PATENT DOCUMENTS 3,857,325 A 12/1974 Thomas
4,481,863 A * 11/1984 Zanner et al. ..... 89/138
4,681,020 A * 7/1987 Polanecky ..... 89/138
5,212,327 A * 5/1993 Schuemann ..... 42/70.01
6,907,814 B2 * 6/2005 Spinner et al. ..... 89/180
7,047,864 B2 * 5/2006 Spinner et al. ..... 89/180

FOREIGN PATENT DOCUMENTS

DE 32 27 180 A1 1/1984
WO 01/63198 A 8/2001
WO WO 01/63198 8/2001

* cited by examiner

*Primary Examiner*—Bret Hayes
(74) *Attorney, Agent, or Firm*—Hoffman, Wasson & Gitler, PC

(57) ABSTRACT

A handheld firearm which is in the form of a self-loading pistol with a bolt lock, having two operating levers which can pivot and each have a handle for operation of the bolt lock, with the operating levers being arranged on mutually opposite sides of the handheld firearm and, when the handheld firearm is in the in-use state, being connected to one another via a pivoting shaft such that they cannot rotate with respect to one another, and at least sections of the operating levers being arranged in the interior of the handheld firearm.

17 Claims, 5 Drawing Sheets

HANDHELD FIREARM

BACKGROUND OF THE INVENTION

The present invention relates to a handheld firearm which is in the form of a self-loading pistol with a bolt lock, having two operating levers which can pivot and each have a handle for operation of the bolt lock, with the operating levers being arranged on mutually opposite sides of the handheld firearm and, when the handheld firearm is in the in-use state, being connected to one another via a pivoting shaft such that they cannot rotate with respect to one another.

A handheld firearm of the type mentioned above is known from the International Patent Application WO 01/63198 A1. Self-loading pistols of the type mentioned above have a breech which can be moved to the rear by the firing of a shot and can be moved forward again by the force of a breech spring. The bolt lock is used to hold the breech fixed in the rear position after the last shot has been fired from the magazine of the weapon in order on the one hand to indicate to the person firing the weapon that the last shot has been fired, and on the other hand to make it easier to change the magazine. The operating levers which are known from the abovementioned international patent application are fitted on the left on the outside and on the right on the outside of the housing of the weapon, with respect to the firing direction, so that the left-hand operating lever can easily be operated by a left-handed person, and the right-hand operating lever can be easily operated by a right-handed person. The two operating levers are connected to one another via a pivoting shaft such that they cannot rotate with respect to one another, and are also fitted to the housing of the handheld firearm via a bayonet fitting.

In the case of the handheld firearm, which is known from the abovementioned international patent application, the housing is integrally connected to a grip, to form a grip part.

The abovementioned handheld firearm from the existing art has been found to have the disadvantage that the operating levers are arranged on the outer faces of the handheld firearm. Firstly, this means that there are no free design options for the outer surface of the handheld firearm in the area in which the operating levers are located. Secondly, pieces of clothing or other objects can be caught in the operating levers, so that the bolt lock can inadvertently be activated or deactivated in this way.

One problem on which the present invention is based is to provide a handheld firearm of the type mentioned initially which is less susceptible and/or can be designed more freely in terms of the external appearance.

SUMMARY OF THE INVENTION

According to the invention, this is achieved in that at least sections of the operating levers are arranged in the interior of the handheld firearm. In this case, each of the handles of the operating levers can be arranged on the outside of the handheld firearm. Furthermore, each of the operating levers may have a holding limb to which the handle is fitted, with the holding limb being arranged in the rear part of the operating lever in the firing direction, and projected out of the handheld firearm in its lateral direction. Furthermore, the handheld firearm may have a housing in whose interior sections of the operating levers are arranged. Thus, with the present invention, only a very small part of the operating levers, specifically in the end only the corresponding handle, projects out of the handheld firearm, so that all of the rest of the operating levers, which in some circumstances may have a length of several centimeters, is accommodated in the interior of the handheld firearm, in particular in the interior of the housing. On the one hand, this allows the external surface of the handheld firearm to be designed more freely in this area. Furthermore, no elements such as clothing or other objects can be caught in the operating levers because, in the end, only a part which is used for operation projects out of the housing, and only in a locally limited form. Furthermore, the design according to the invention results in the handheld firearm being thin and compact.

It is possible to provide for the housing to have two mutually opposite side walls. In this case, each of the side walls may have a groove for holding a section of the corresponding operating lever. In an embodiment such as this, the operating lever can be designed to be very light and thin since the parts of the side walls which surround the groove ensure that the operating levers are guided at the side. This also prevents tilting of the operating levers, so that the tolerances relating to the operating levers and the pivoting shaft can be chosen to be wider.

Alternatively, it is possible to provide for each of the side walls to have a cutout, which is arranged on its inside, for holding a section of the corresponding operating lever. This allows the operating lever to be made more robust by making contact with the inner face of the corresponding side wall.

It is also possible for each of the side walls to have a recess for the holding limb of the corresponding operating lever to pass through.

It is also possible to provide for at least one of the side walls to have a hole for the pivoting shaft to pass through. If only one hole is provided, the pivoting shaft can be inserted through this hole into the housing and into the operating levers, which, for example, are located in the grooves, in which case all that is necessary is to secure the pivoting shaft against axial movement in one direction. If two holes are provided on both sides of the handheld firearm, the pivoting shaft must in some circumstances be secured against axial movement in both directions.

It is possible to provide for each of the operating levers to have a hole with an internal tooth system for holding an external tooth system on the pivoting shaft. The interaction of the internal tooth system and external tooth system results in the operating levers and the pivoting shaft being connected such that they cannot rotate with respect to one another, so that the bolt lock can be operated, and in particular can be deactivated, via the operating levers from both the right-hand side and the left-hand side, so that the breech can move forward.

Further, it is possible to provide for the handheld firearm to have an insert piece to which the operating levers can be fitted. In this case it is possible to provide for the insert piece to be essentially U-shaped with two U limbs. Furthermore, it is possible to provide a hole for the pivoting shaft to pass through in each of the U limbs.

It is also possible to provide for the capability for the operating levers to be fitted to the outside of the insert piece. Once this insert piece has been fitted into the grip or housing of the handheld firearm, the inside of the operating lever can rest on the insert piece and its outside can rest on the side wall of the housing, thus ensuring good guidance of the operating lever at the side.

Alternatively, it is possible to provide for the capability for the operating levers to be fitted into corresponding grooves in the interior of the insert piece. This likewise ensures that the operating levers are guided well at the side.

It is possible for the pivoting shaft to have a continuous external tooth system. In the case of a pivoting shaft with a continuous tooth system such as this, both operating levers, for example, can be inserted into one groove at the same time, and the pivoting shaft can then be inserted into the grip or the housing.

Alternatively, it is possible for the pivoting shaft to have an external tooth system in each of its end areas. In this case, a first of the external tooth systems can be longer in the axial direction than a second of the two external tooth systems. In this case, it has been found to be advantageous that the shaft needs to be secured only against axial movement in one direction, owing to the different tooth system depths, because axial movement in the direction of the smaller tooth system depth can take place only as far as a point at which the end of the shorter tooth system is already resting on the corresponding operating lever while, in contrast, the other end of the pivoting shaft, which is provided with the longer tooth system, has not yet emerged from the other operating lever.

It is possible to provide for the pivoting shaft to be secured against axial movement by means of a breech, which is fitted to the handheld firearm. This allows the pivoting shaft to be secured with very simple means in the housing and in the handheld firearm.

Alternatively, the pivoting shaft can be secured against axial movement by contact with the inner faces of the side walls. By way of example, this can be achieved automatically with the embodiment with the insert piece by the side walls having no holes for the pivoting shaft.

BRIEF DESCRIPTION OF THE DRAWINGS

Further features and advantages of the present invention will become clear from the following description of preferred exemplary embodiments and with reference to the attached figures, in which.

DETAILED DESCRIPTION OF THE INVENTION

Figure 1:
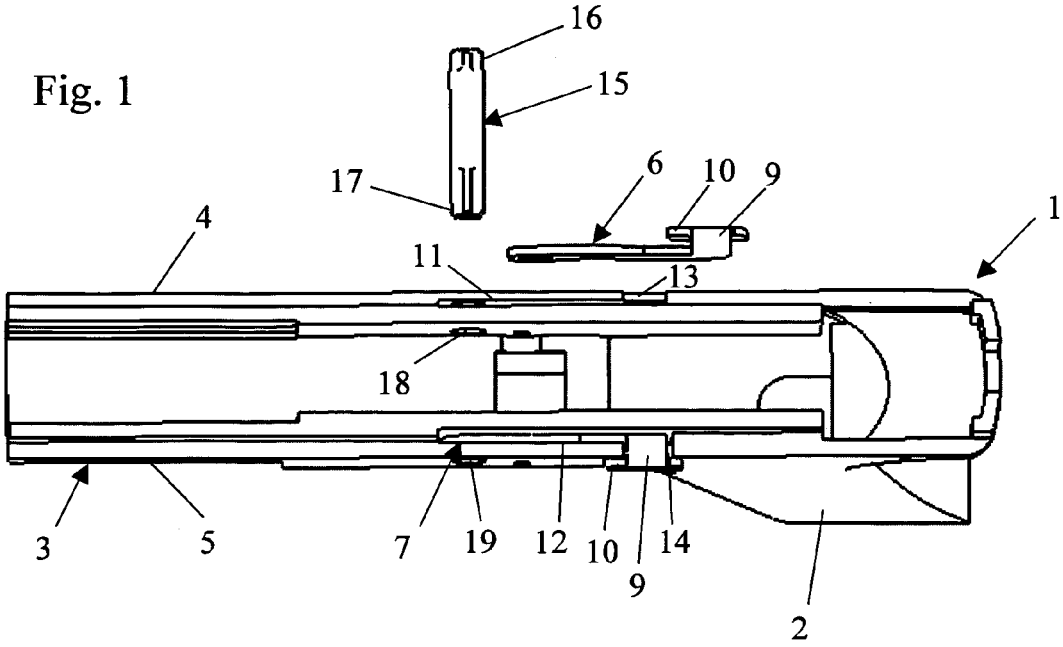
FIG. 1 shows a perspective exploded view of a grip of a handheld firearm according to the invention with an operating lever inserted.

The embodiment of a handheld firearm which is shown in FIG. 1 to FIG. 5 has a grip 1 which has a handle 2 for the hand of the person firing the weapon and has a housing 3, which is open at the top and has side walls 4, 5 which extend in the longitudinal direction of the barrel. A frame, which is not illustrated but holds the barrel, can be fitted into the housing 3 which is open at the top, in which case a breech 26, can be fitted to the housing 3 and can move in the longitudinal direction of the housing 3, and thus in the firing direction and in the opposite direction to the firing direction, in a manner which is known per se.

The handheld firearm also has two operating levers 6, 7, which can each be fitted in the area of one of the side walls 4, 5. The illustrated handheld firearm is in the form of a self-loading pistol. Self-loading pistols such as these have a bolt lock which holds the breech firmly in a rear position after the last shot has been fired in order on the one hand to indicate to the person firing the weapon that the last shot has been fired, and on the other hand to make it easier to change the magazine. The abovementioned operating levers 6, 7 allow the person firing the weapon to operate the bolt lock so that the breech moves forward to its original position again after operation of the operating levers 6, 7. In this case, the lower operating lever 7 in FIG. 1, which is thus on the left-hand side in the firing direction, is intended for operation by a person firing the weapon who is left-handed, and the upper operating lever 6 in FIG. 1, which is thus on the right-hand side in the firing direction, is intended for use by a person firing the weapon who is right-handed.

Figure 6:
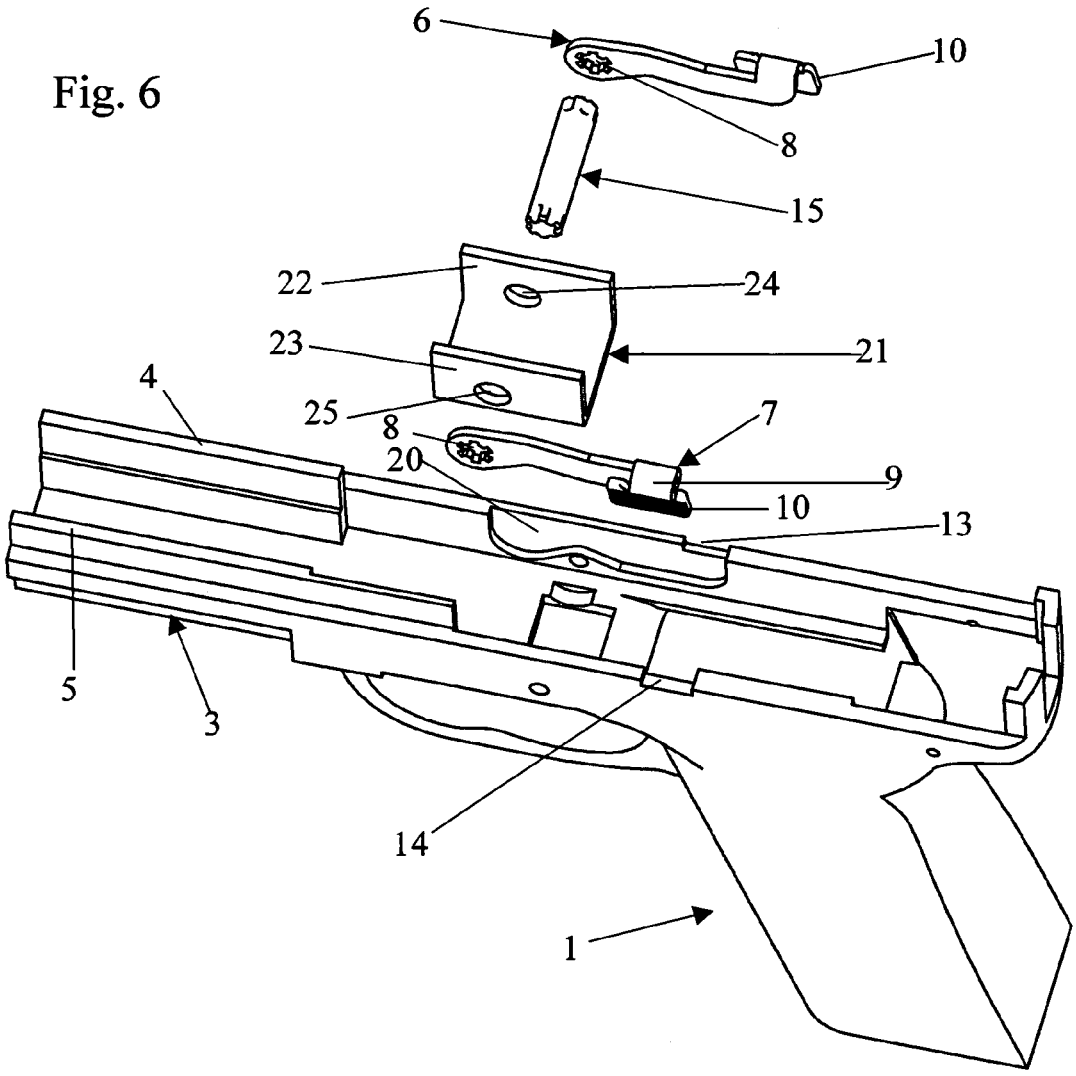
FIG. 6 shows a perspective exploded view of a grip, of an insert piece, of two operating levers and of a pivoting shaft of a second embodiment of a handheld firearm according to the invention.
Figure 9:
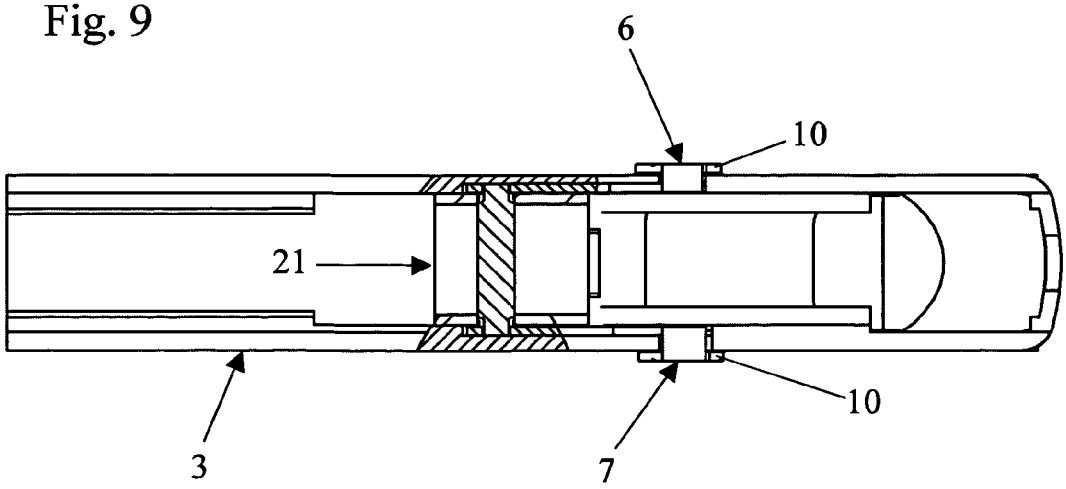
FIG. 9 shows a plan view of the grip of the handheld firearm in the state shown in FIG. 8.

At its front end in the in-use position, each of the operating levers 6, 7 has a hole 8 with an internal tooth system (in this context, see the physically identical operating levers in FIG. 6). Furthermore, at its rear end in the in-use position, each of the operating levers 6, 7 has a holding limb 9 which extends through about 90° from the operating lever to the outside of the handheld firearm and to whose end a handle 10 is fitted, which extends somewhat downwards from the holding limb 9.

In the grip 1 of the embodiment shown in FIG. 1 to FIG. 5, the groove 11, 12 which extends in the longitudinal direction of the handheld firearm is provided in each of the side walls 4, 5, for the fitting of the corresponding operating lever 6, 7. Furthermore, a recess 13, 14 is arranged in the corresponding side wall 4, 5 of the grip at the respective rear end of the groove 11, 12 when the handheld firearm is in the in-use position. When the operating levers 6, 7 have been fitted in the grooves 11, 12, the respective holding limb 9 of the operating lever 6, 7 extends through the recess 13, 14 to the right or to the left, respectively, out of the housing 3. This can be seen particularly clearly in FIG. 5, which illustrates the installed state of the operating levers 6, 7.

Figure 2:
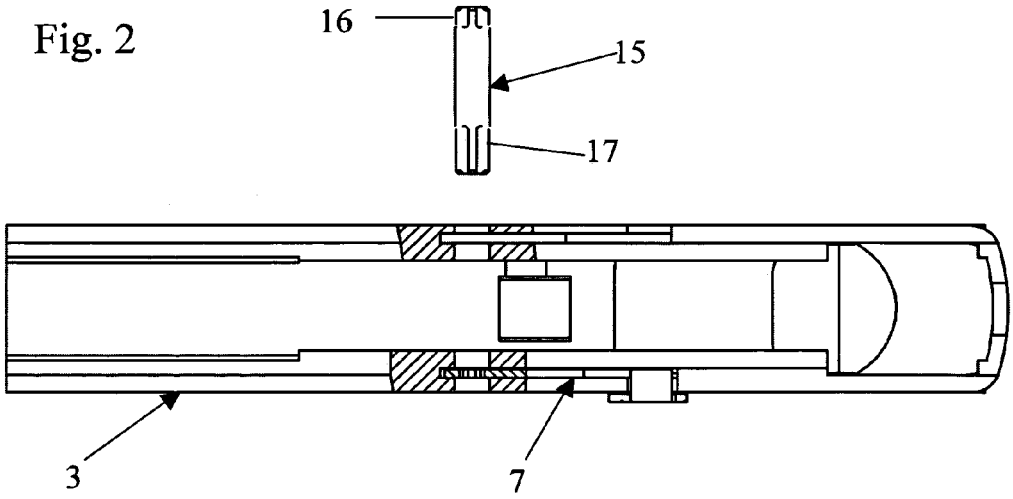
FIG. 2 shows a partially sectioned plan view of the grip shown in FIG. 1.

FIG. 1 and FIG. 2 show the handheld firearm in a state in which the left-hand operating lever 7 in the firing direction has been inserted into the corresponding groove 12 while, in contrast, the right-hand operating lever 6 in the firing direction has not yet been inserted into the corresponding groove 11. The handheld firearm furthermore has a pivoting shaft 15, which is used for fitting the operating levers 6, 7 in the grip 1. The pivoting shaft 15 which is illustrated in FIG. 1 to FIG. 5 has external tooth systems 16, 17 at each of its ends, with the upper or first external tooth system 16 in FIG. 1 and FIG. 2 extending over a shorter section of the pivoting shaft 15 than the lower or second external tooth system 17 in FIG. 1 and FIG. 2.

The side walls 4, 5 have holes 18, 19 that are aligned with one another in the lateral direction of the housing 3 and through which the pivoting shaft 15 can extend. When the operating levers 6, 7 have been inserted into the corresponding grooves 11, 12, the holes 8 in the operating levers 6, 7 are in this case aligned with the corresponding holes 18, 19 in the grip 1.

Figure 3:
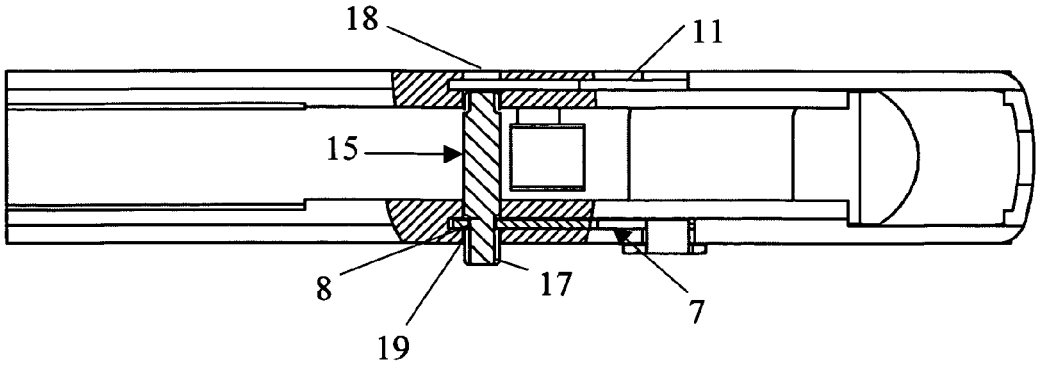
FIG. 3 shows a view corresponding to FIG. 2, with a pivoting shaft fitted in the grip.
Figure 4:
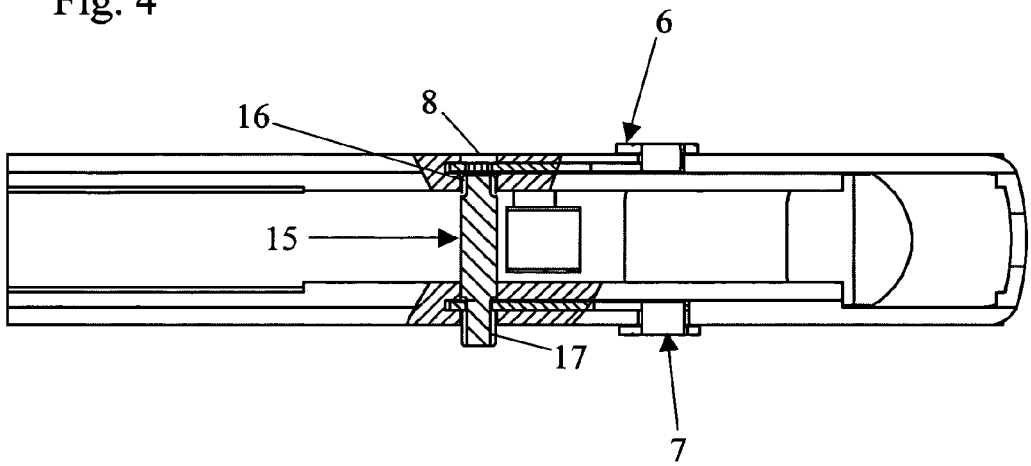
FIG. 4 shows a view corresponding to FIG. 2, with a second operating lever additionally fitted in the grip, which has not yet been secured by the pivoting shaft.

FIG. 3 shows the handheld firearm in a state in which the left-hand operating lever 7 in the firing direction has been fitted into the corresponding groove 12, and in which, furthermore, the pivoting shaft 15 has been passed through the corresponding holes 18, 19 and through the hole 8 in the operating lever 7 from above in FIG. 3, or from the right-hand side of the handheld firearm. However, as can be seen from FIG. 3, the second, longer external tooth system 17 has been pushed through the hole 8 in the operating lever 7 that has been introduced sufficiently far that the upper or right-hand end of the pivoting shaft 15 in FIG. 3 no longer engages in the groove 11 which is arranged in the right-hand side wall. This makes it possible to insert the second operating lever 6 from above despite the pivoting shaft 15 having been fitted in the groove 11. FIG. 4 shows the right-hand operating lever 6 in the inserted state.

Figure 5:
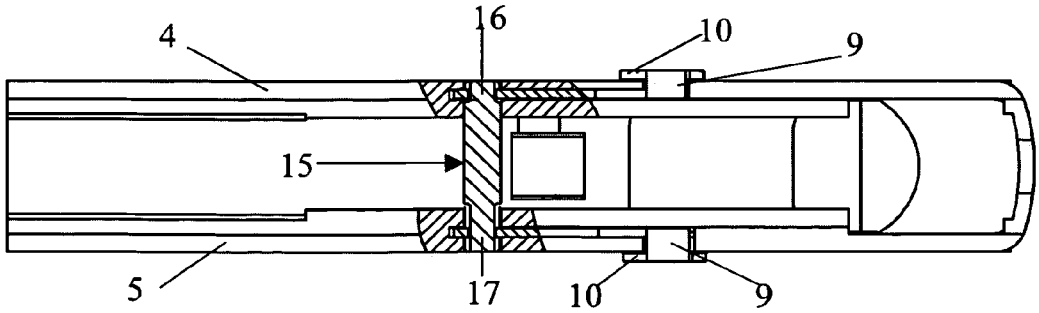
FIG. 5 shows a view corresponding to FIG. 2, with two pivoting levers, which are secured in the grip by means of the pivoting shaft.

Once the right-hand operating lever 6 has been inserted, the pivoting shaft 15 can be pushed upward in FIG. 4 and FIG. 5, or to the right in the lateral direction of the handheld firearm. This movement of the pivoting shaft 15 results in the right-hand external tooth system 16 engaging with the internal tooth system which is located in the hole 8 in the right-hand operating lever 6. In this state (see FIG. 5), the pivoting shaft 15 ends essentially flush with the side walls 4, 5 on both sides of the housing 3. In this state, the pivoting shaft 15 can be secured against axial movement by methods which are known from the field of weapons, for example by means of a transverse groove or depression in the pivoting shaft, in which a spring limb, a pin or some other element can engage.

This engagement can be supported, in particular, by spring pressure. It is also possible to cover the hole opening of the hole 19 which is arranged on the left-hand side, for example by means of the breech (which is not shown) or by means of other operating elements for the handheld firearm. Owing to the fact that the pivoting shaft 15 has an external tooth system 16, 17 of different length at its two ends, the pivoting shaft 15 need be secured only against axial movement in one direction, in particular against movement to the left in FIG. 5.

When the breech is fitted to the grip 1 only the handles 10 of the operating levers 6, 7 can be seen from the outside of the weapon, in which case these handles 10 can easily be pushed upward, in particular through a comparatively small angle of about 5°, in order to operate the bolt lock. The connection of the operating levers 6, 7 via the pivoting shaft 15 such that they cannot rotate with respect to one another in this case allows the bolt lock to be operated both by the left-hand operating lever 7 and by the right-hand operating lever 6.

According to the invention, it is also quite possible to use a pivoting shaft with a continuous external tooth system. In the case of a shaft such as this, this shaft must be secured against axial movement in both directions when the operating levers are in the installed state. In the case of a pivoting shaft such as this with a continuous external tooth system, it is likewise possible for one of the holes in the side walls of the grip for the pivoting shaft to pass through to be closed such that the shaft can be fitted into the grip from only one of the sides. In the case of a variant such as this, the pivoting shaft likewise need be secured against axial movement in only one direction.

In the embodiment shown in FIG. 6 to FIG. 10, identical parts are provided with the same reference symbols as in FIG. 1 to FIG. 5. As can be seen from FIG. 6, no grooves are provided in the side walls 4, 5 of the housing 3, but cutouts 20, which are matched to the shape of the operating levers 6, 7. Once again, a corresponding recess 13, 14 is provided at the end of the respective cutout 20, for the holding limb 9 of the respective operating lever 6, 7 to pass through.

Furthermore, the embodiment shown in FIG. 6 to FIG. 9 has an essentially U-shaped insert piece 21 which has holes 24, 25, which are aligned with one another, in its two mutually opposite U limbs 22, 23 for the pivoting shaft 15 to pass through.

Figure 7:
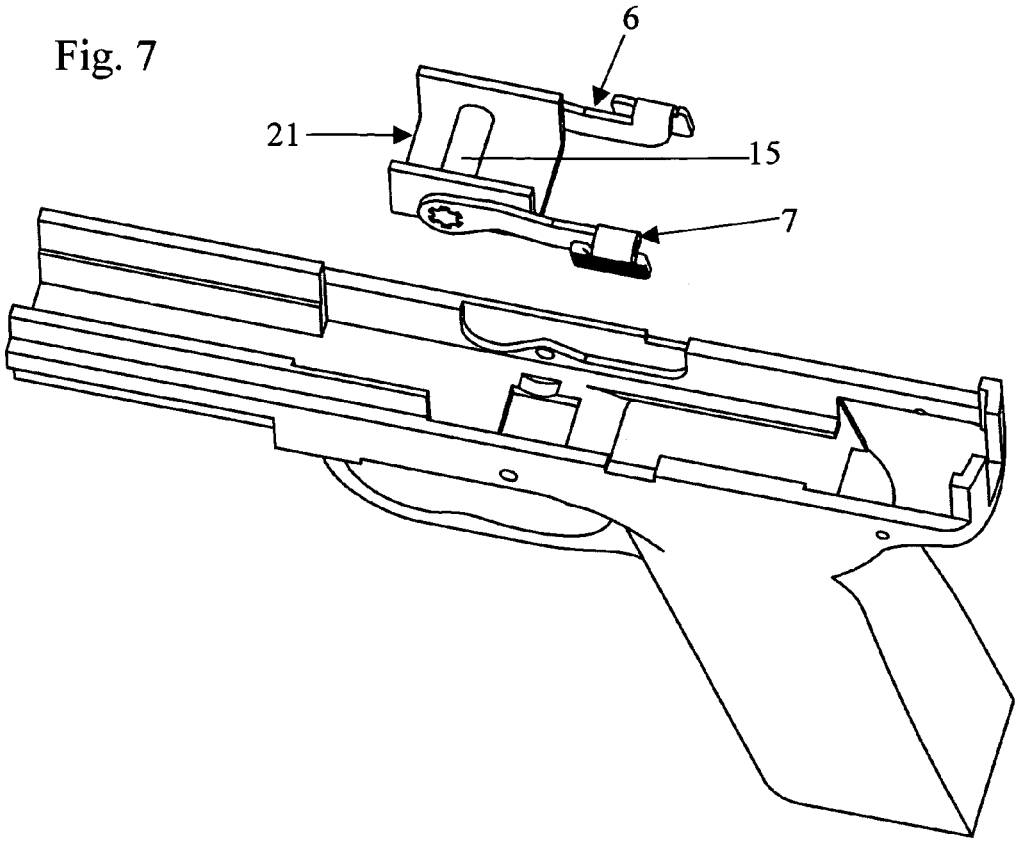
FIG. 7 shows a view corresponding to FIG. 6, in which the operating levers and the pivoting shaft are connected to the insert piece.
Figure 8:
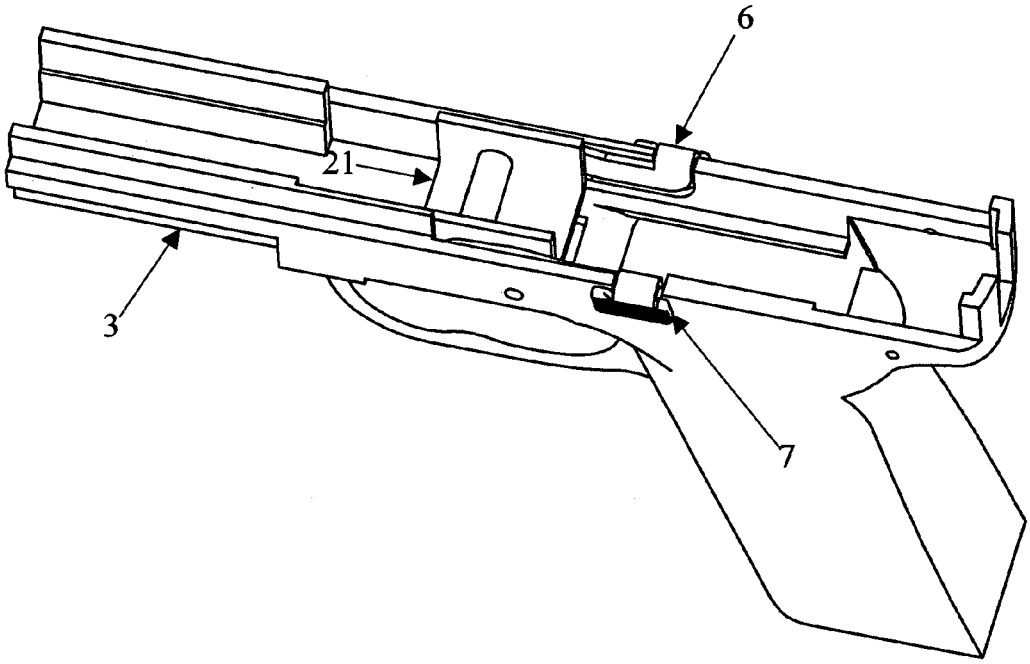
FIG. 8 shows a view corresponding to FIG. 6, in which the insert piece is fitted into the grip with the operating levers and the pivoting shaft.
Figure 10:
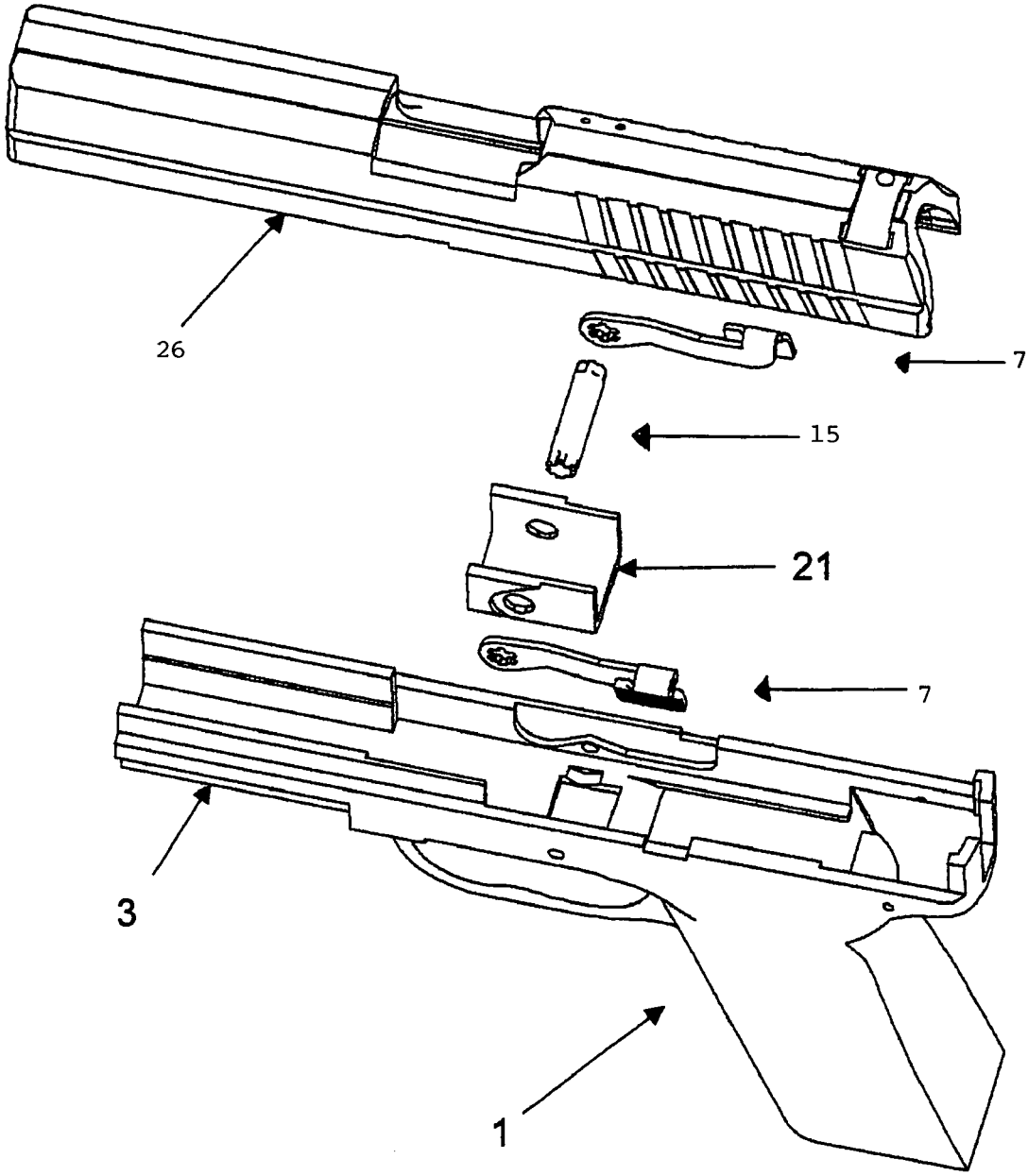
FIG. 10 shows a perspective exploded view of a grip, of an insert piece, of two operating levers, of a pivoting shaft, and a breech according to the invention.

As can be seen from FIG. 7, the operating levers 6, 7 can be attached to the insert piece 21 by insertion of the pivoting shaft 15 into the holes 24, 25 and incorporating the hole 8 in the operating levers 6, 7.

After this, the insert piece 21 can be inserted together with the operating levers 6, 7 into the housing 3, in such a way that the pivoting levers 6, 7 are arranged in a comparably fitting manner in the cutouts 20 and the holding limbs 9 as well as the handles 10 project out of the housing on the left and right. This state can be seen in FIG. 8 and in the plan view in FIG. 9.

According to the invention, it is also possible for the operating levers 6, 7 not to be mounted on the outside of the U limbs 22, 23 of the insert piece 21, but in a groove which is provided in each of the U limbs 22, 23.

When an insert piece 21 is used, the pivoting shaft 15 need not be secured against axial movement, because the ends of the pivoting shaft 15 rest on the inner faces of the side walls 4, 5 that, in this embodiment, do not have any holes.

LIST OF REFERENCE SYMBOLS

1 grip
2 handle
3 housing
4, 5 side wall
6, 7 operating lever
8 hole in 6, 7
9 holding limb
10 handle
11, 12 groove in 4, 5
13, 14 recess in 4, 5
15 pivoting shaft
16, 17 external tooth system on 15
18, 19 hole in 4, 5
20 cutout in 4, 5
21 insert piece
22, 23 U limb of 21
24, 25 hole in 22, 23
26 breech

What is claimed is:

1. A handheld firearm in the form of a self-loading pistol with a bolt lock, comprising two operating levers which can pivot and each have a handle on an outside of the firearm for operation of the bolt lock, with the operating levers being arranged on mutually opposite sides of the handheld firearm and, when the handheld firearm is in the in-use state, being connected to one another via a pivoting shaft such that they cannot rotate with respect to one another, wherein an entire length of the operating levers extend in an interior of the handheld firearm between the pivoting shaft and the handle.

2. The handheld firearm as claimed in claim 1, wherein each of the operating levers has a holding limb to which the handle is fitted, with the holding limb being arranged in a rear area of the operating lever in a firing direction, and projecting out of the handheld firearm in its lateral direction.

3. The handheld firearm as claimed in claim 2, wherein each of the side walls has a recess for the holding limb of the corresponding operating lever to pass through.

4. The handheld firearm as claimed in claim 1, wherein the handheld firearm has a housing in whose interior sections of the operating levers are arranged.

5. The handheld firearm as claimed in claim 4, wherein the housing has two mutually opposite side walls.

6. The handheld firearm as claimed in claim 5, wherein each of the two mutually opposite side walls has a groove for holding a section of a corresponding operating lever.

7. The handheld firearm as claimed in claim 5, wherein each of the side walls has a cutout, which is arranged on its inside, for holding a section of the corresponding operating lever.

8. The handheld firearm as claimed in claim 5, wherein at least one of the side walls has a hole for the pivoting shaft to pass through.

9. The handheld firearm as claimed in claim 1, wherein each of the operating levers has a hole with an internal tooth system for holding an external tooth system on the pivoting shaft.

10. The handheld firearm as claimed in claim 1, wherein the pivoting shaft has a continuous external tooth system.

11. The handheld firearm as claimed in claim 1, wherein the pivoting shaft has an external tooth system on each of its end areas.

12. The handheld firearm as claimed in claim 11, wherein a first of the external tooth systems is longer in the axial direction than a second of the two external tooth systems.

13. The handheld firearm as claimed in claim 1, wherein the pivoting shaft is secured against axial movement by means of a breech, which is fitted to the handheld firearm.

14. A handheld firearm in the form of a self-loading pistol with a bolt lock, comprising two operating levers which can pivot and each have a handle for operation of the bolt lock, with the operating levers being arranged on mutually opposite sides of the handheld firearm and, when the handheld firearm is in the in-use state, being connected to one another via a pivoting shaft such that they cannot rotate with respect to one another, wherein at least sections of an entire length of the operating levers are arranged in an interior of the handheld firearm and wherein the operating levers have an insert piece to which the operating levers are fitted and wherein the insert piece is essentially U-shaped with two U limbs.

15. The handheld firearm as claimed in claim 14, wherein a hole for the pivoting shaft to pass through is provided in each of the U limbs.

16. The handheld firearm as claimed in claim 14, wherein the operating levers can be fitted to the outside of the insert piece.

17. A handheld firearm in the form of a self-loading pistol with a bolt lock, comprising two operating levers which can pivot and each have a handle for operation of the bolt lock, with the operating levers being arranged on mutually opposite sides of the handheld firearm and, when the handheld firearm is in the in-use state, being connected to one another via a pivoting shaft such that they cannot rotate with respect to one another, wherein at least sections of the operating levers are arranged in an interior of the handheld firearm and wherein the pivoting shaft is secured against axial movement by contact with the inner faces of the side walls.

* * * * *

UNITED STATES PATENT AND TRADEMARK OFFICE

CERTIFICATE OF CORRECTION

PATENT NO. : 7,313,996 B2
APPLICATION NO. : 11/100638
DATED : January 1, 2008
INVENTOR(S) : Martin Werner It is certified that error appears in the above-identified patent and that said Letters Patent is hereby corrected as shown below:

On the Title page insert the following:

(30) Foreign Application Priority Data

April 8, 2004 (DE) ..... 10 2004 018 149

Signed and Sealed this

Seventeenth Day of June, 2008

JON W. DUDAS
*Director of the United States Patent and Trademark Office*